United States Patent [19]

Hostetter

[11] 3,994,631

[45] Nov. 30, 1976

[54] PUMP AND PUMP MANIFOLD ASSEMBLY WITH ADJUSTABLE BALL VALVE

[76] Inventor: William L. Hostetter, 5154 Eagle Rock Blvd., Los Angeles, Calif. 90041

[22] Filed: Aug. 20, 1974

[21] Appl. No.: 499,050

[52] U.S. Cl. ..... 417/506; 417/568; 417/900

[51] Int. Cl.[2] ..... F04B 39/08; F04B 39/10

[58] Field of Search ..... 417/506, 427, 486, 900, 417/265, 267, 254, 568, 569, 454; 137/533.11

[56] References Cited

UNITED STATES PATENTS

| | | | |
|---|---|---|---|
| 932,153 | 8/1909 | Martin | 137/533.11 |
| 2,007,888 | 7/1935 | Ball | 417/427 |
| 2,311,229 | 2/1943 | Herbert | 417/568 |
| 2,367,893 | 1/1945 | Sheen | 417/454 |
| 2,448,104 | 8/1948 | Longenecker | 417/265 |
| 2,609,756 | 9/1952 | Wright et al. | 417/454 |
| 2,733,664 | 2/1956 | Saalfrank | 417/454 |
| 2,745,349 | 5/1956 | Tavola | 417/506 |
| 3,104,619 | 9/1963 | Swarthout | 417/900 |
| 3,172,363 | 3/1965 | Bennett et al. | 417/900 |
| 3,597,114 | 8/1971 | Hrdina | 417/265 |

FOREIGN PATENTS OR APPLICATIONS

| | | | |
|---|---|---|---|
| 860,035 | 1/1971 | Canada | 417/568 |

*Primary Examiner*—William L. Freeh
*Attorney, Agent, or Firm*—Blakely, Sokoloff, Taylor & Zafman

[57] ABSTRACT

A piston or diaphram and a pump manifold assembly having an adjustable ball valve is disclosed. The manifold comprises first and second flanged chambers for mounting to the pump, a conduit or passageway which joins the two chambers and ball valves positioned in and near the first flanged chamber. The ball valves allow the manifold to pump materials of various sizes without the problems associated with the prior art. As specifically disclosed, the distance the ball may travel in the first chamber is controlled by at least one shaped pin positioned in the area of the valve which is easily removable without the need for disconnecting the manifold from the pump or without removal of the balls from the valves. By use of the pump and pump manifold assembly of the present invention, a continuous flow of material of varying sizes can be achieved without substantial surge. In addition, the assembly is easily cleaned, repaired and modified without the need for complete removal from the pump or expensive equipment.

11 Claims, 6 Drawing Figures

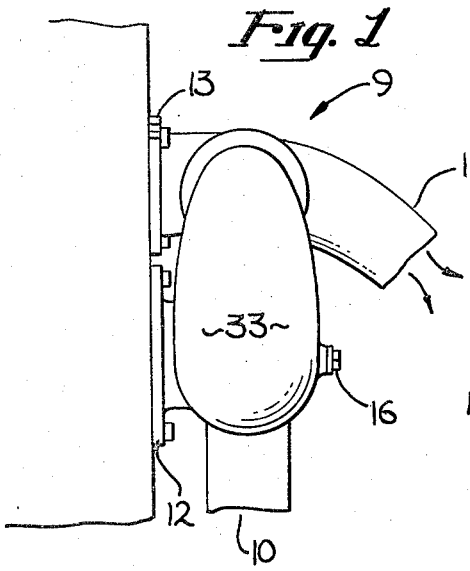
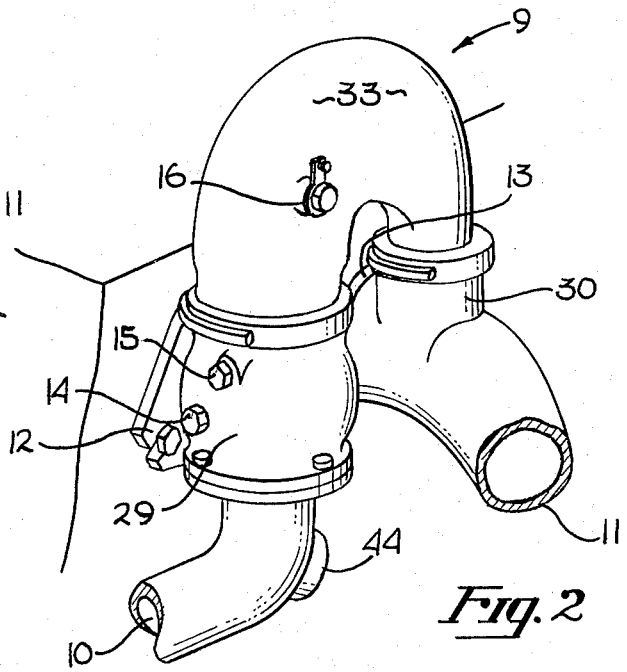
Fig. 2
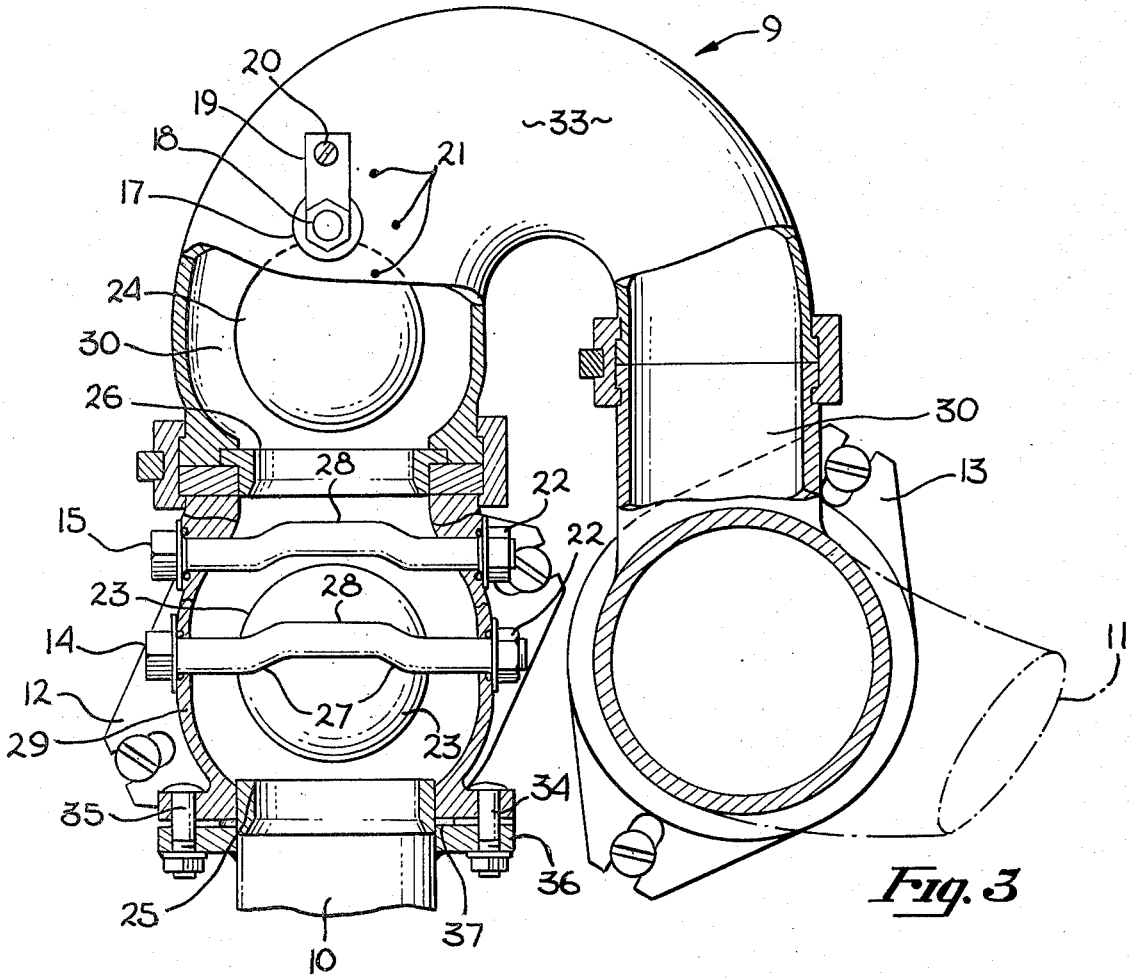
Fig. 3

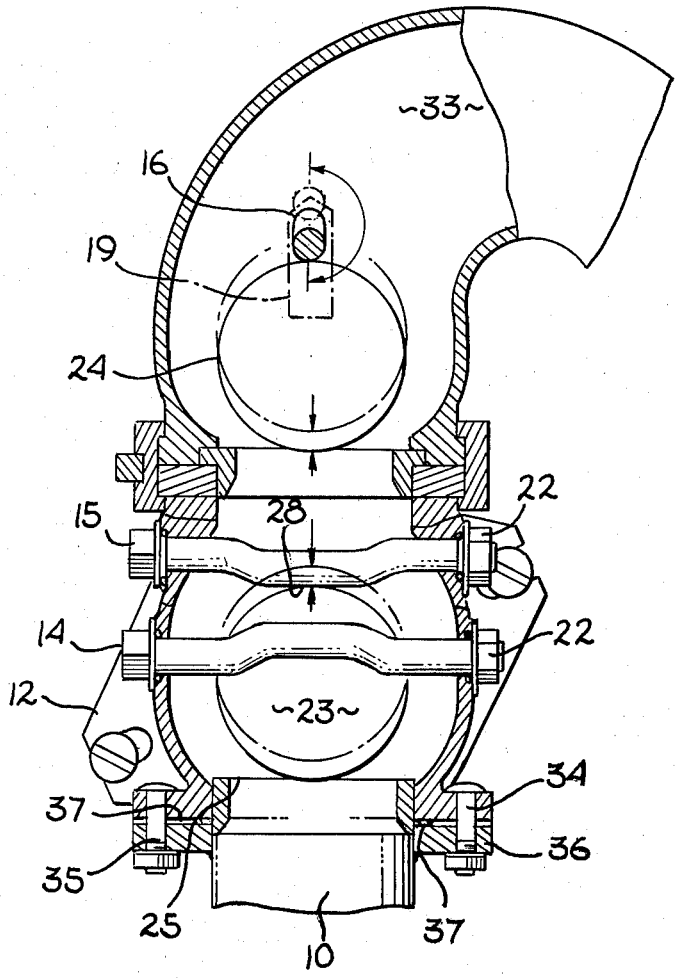
Fig. 4
Fig. 5a
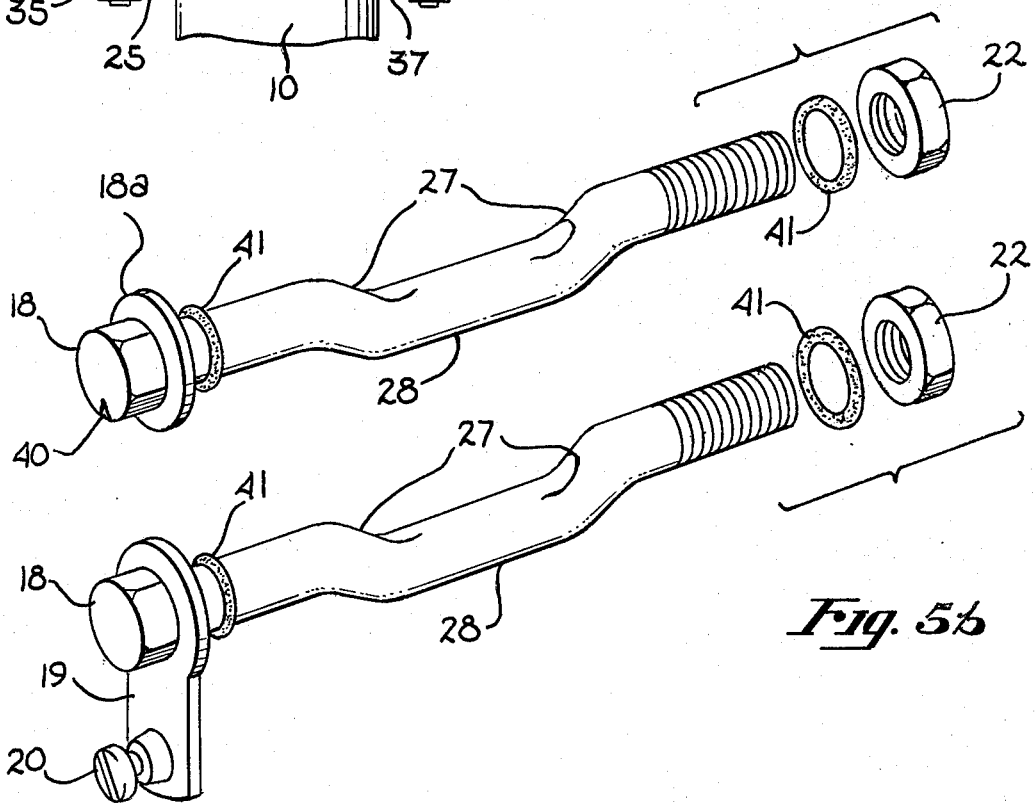
Fig. 5b

PUMP AND PUMP MANIFOLD ASSEMBLY WITH ADJUSTABLE BALL VALVE

BACKGROUND OF THE INVENTION

1. Field of the Invention

The present invention relates to the field of pumps and pump attachments.

2. Prior Art

Piston and diaphram pumps are well known in the art and have been used to pump a wide variety of materials. Such pumps usually utilize a ball valve comprised of a ball and valve seat disposed to the pump in order to achieve unidirectional flow and a means for drawing the piston or diaphram. A preferred embodiment is a dual piston pump adapted to pump concrete. Hereinafter the present invention will be described with reference to such pumps. It is to be understood, that single and multiple piston pumps are within the scope of the present invention and give advantageous results when used in accordance with the present invention hereinafter described. Further materials other than concrete may advantageously be pumped by the pump manifold assemblies within the scope of the present invention. floors or walls are being constucted in a multi floored dwelling, the concrete can be mixed on the ground or in transit in readimix trucks and then pumped to the desired elevation for use. However, these prior art pumps have a number of shortcomings which, until the present invention, tended to cause surge in the concrete pressure and flow, causing accelerated wear and deterioration of the pump and associated equipment.

The source of the surge may be appreciated by considering the nature of the task such pumps are required to perform. Typically such pumps utilize ball valves, with one valve controlling the unidirectional flow for providing an inlet to a piston clinder assembly, and a second valve for providing a unidirectional flow outlet for that piston cylinder assembly. The ball valves are characterized by a valve seat of a smaller diameter than the ball, with the ball motion being theoretically limited in travel between the ball seat and some limiting or stopping device such as a pin or other device for retaining the ball within bounds. Pumps characteristically utilize a dual piston cylinder arrangement whereby one piston delivers concrete to the outlet port during one half of the delivery cycle, with the second piston havng a specially shaped stroke intended to maintain uniform flow through the first half of the cycle and to itself deliver concrete during the second half of the cycle to similarly maintain the flow during the intake stroke of the first piston. While theoretically uniform delivery pressure and flow from the dual piston pump is not too difficult to obtain, secondary effects have a substantial effect on the ball valve performance which in turn can cause excessive surging in the flow and pressure of the concrete delivered by the system. In particular, the balls in the ball valves in practice do not actually totally close against the valve seat, but instead tend to close within approximately the aggregate size of the valve seat. Accordingly, as aggregate size varies from pea gravel to aggregate up to as large as three-fourths inch, the so-called closed position of the balls in the ball valves may vary by a substantial part of an inch.. If the maximum open position of the balls in the ball valves is a fixed position, then obviously the amount of back flow encountered before valve closure will vary substantially with the nature of the concrete and particularly the aggregate size in the concrete being pumped. This causes the surge and pressure fluctuation previously mentioned.

Also prior art pump manifolds are characteristically welded assemblies fabricated in substantial part from standard steel tubing and fittings. Accordingly, the ball valves typically are comprised of a cylindrical enclosure for the ball, bounded at one end by some form of annular inward extending valve seat, with means being provided for fixing the other limit of ball travel. The net result of such pump is that the manifold system provides rather substantial flow area discontinuities which tend to cause flow restriction and on ocassion outright jamming of the pump. Also, it will be noted that immediately adjacent the circumference of the ball there is a minimum concrete flow area, while at each side of the ball along the flow path there is a maximum flow area. Accordingly, the variation in flow area tends to cause jamming or packing as previously mentioned, and in addition, the regions of large flow area result in a greater than necessary volume of concrete in the manifold. While concrete itself is substantially incompressable, there may be substantial entrainment of air in the concrete, which of course is compressable, with the net result that surge may also be encountered because of the presence and/or variation in air in the mix, a factor dependent primarily upon the amount of water in the mix.

One prior art attempt to overcome some of these problems is described by Conklin, U.S. Pat. No. 2,734,667. Conklin utilizes a dual piston concrete pump wherein the valve equipped pistons comprised a ball which was disposed in a wire-like cage. On the downward stroke of the piston, the ball in cage closed the passageway between the feed stream and the outlet. On the upward stroke, the ball travelled until it came into contact with the bottom of the cage. A second ball valve was positioned beneath the ball valve in the cage. This second ball valve travelled between its valve seat and permanent radial pins disposed along the passageway. Another prior art concrete pump is disclosed by Delligatti, U.S. Pat. No. 3,140,801. Delligatti's pump also comprises a dual ball valve arrangement positioned along the passageway through which the concrete is pumped. In Delligatti's pump, each ball valve is retained between a valve seat and a permanent restricting means. In both the Conklin and the Delligatti concrete pumps, the problem or surging and of easily removable valves so as to provide for a method of cleaning the valves was not effectively solved as their pumps are complicated having a large number of components. Further, these prior art pumps suffer the previously discussed problem of not enabling the user the ability to change aggregate size without extensive modification to the pump. For example, Delligatti discussed the need for various piston chamber diameters.

In the present invention the problem of surging is effectively solved by adjusting the distance the ball may travel in the ball valves. In U.S. Pat. Nos. 2,734,677 and 3,140,801, while there was a disclosure of a pin being used to adjust the distance the ball in the ball valve was able to travel, this pin is not adjustable. Once the pin was in place, the distance of ball travel was permanently fixed. In the present invention, there is an easily modifiable means which provides a number of different settings which allows the balls to travel different distances in the ball valves, this providing a solution to the problem of surging in the concrete being pumped. Further, the present invention provides an assembly that is easily disassembled and cleaned.

BRIEF SUMMARY OF THE INVENTION

The present invention relates to a pump and a pump manifold assembly which is to be mounted on, for example, a dual piston concrete pump. The manifold comprises a first flange for mounting to the first cylinder of the pump and a second flange for mounting to the second cylinder of the pump. There is a first chamber disposed near the first flange which contains a first ball valve. Also in the first chamber is an inlet means which supplies the first chamber with the aggregate concrete mixture to be pumped through the manifold to the point of use. When the piston in the first cylinder is in the withdrawal stroke, the aggregate mixture is drawn into the first chamber. As the piston in the first chamber is going into the power stroke, the first ball is driven downward into the valve seat thereby causing the concrete aggregate mixture to flow into a passageway that joins the first chamber with the second chamber. Disposed above the first ball valve is a second ball valve. During the power stroke of the first piston, the second ball valve is opened thereby permitting the concrete to flow partly into the second chamber and partly through a delivery port. Both the first ball valve and the second ball valve are restricted in the distance they may travel by specially shaped adjustable pins. These pins enable the ball valves to be easily adjusted so as to accomodate a change from one aggregate size to another without encountering substantial surge by the simple adjustment of the pins. In the second chamber, which is mounted to the second piston of the pump by a second flange, the aggregate mixture is pumped out the delivery port to the point of application during the withdrawal stroke of the first piston, being restricted in backflow by the second ball valve.

These pins restrict the travel of the balls in the ball valves and are shaped so as to be retrievable from the manifold without the requirement for the removal of the balls, disassembly of the manifold or any cutting and welding operation. When a pin is detached from the manifold, it may be partially extracted from the manifold and then twisted such that it slips out of the manifold completely. This allows the pins to be changed should they become warn because of the abrasive nature of the aggregate. This also allows for the quick changing of the balls should a change in balls be desired; such as a desired change in ball weight and/or size. The adjustability of the pins allows adjustment of the ball travel to minimize surge regardless of aggregate size, by allowing the balls to move further from the valve seat in the open position to make up for the fact that the ball is held off the seat when closed by an amount dependent on the aggregate size.

Besides providing a means for controlling surge, there are at least two additional reasons to adjust the balls in the ball valves. First, being able to adjust the balls, allows for clearance of larger aggregate size through the pump manifold. Larger aggregate may be present because it is desired, or because in some concrete mixes, there is a certain amount of "bad material." Bad material, has an undesirably large size and in many prior art pumps, would cause jamming. By adjusting the balls in the ball valves, this bad material is allowed to pass through the pump. Second, one may desire to pump "gap graded material". Gap graded material is a mixture of aggregate sizes wherein some of the sizes are not present. Generally, the presence of a uniform range of aggregate sizes tends to make the mixture flow easily. Absence of certain sizes, especially the smaller sizes, tends to make the flow more difficult, and may even block up the pump. Adjusting the balls in the ball valves, helps prevent or relieve blockage in the pump and provides a means of pumping gap graded material.

In addition, being able to adjust the ball valves has great utility when materials other than concrete are being pumped.

The present invention also includes a novel manifold assembly made up of three castings which, together with the adjustment pins, provides maximum flow cross sectional area for minimum manifold volume so as to minimize the effects of the compressibility of entrapped air and to provide minimum flow restraint. Smooth flow is also aided by the absence of abrupt change in flow area and direction in the manifold system.

The novel features which are believed to be characteristic of the invention, both as to its organization and method of operation, together with further objectives and advantages thereof will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

BRIEF DESCRIPTION OF THE DRAWNGS

FIG. 1 is a top view of the concrete pump manifold assembly mounted on a dual piston concrete pump.

FIG. 2 is a perspective view of the concrete pump manifold assembly shown as mounted on a dual action pump and with the intake and outlet means.

FIG. 3 is a cutaway view of the pump manifold assembly illustrating the details of the ball valves and adjustment pins.

FIG. 4 is another cutaway of the pump manifold assembly showing the effect of adjusting the pins on the distance the balls in the ball valves may travel.

FIG. 5*a* is a perspective view of the shaped pin used to vary the distance a ball in the first ball valve may travel.

FIG. 5*b* is a perspective view showing the shaped pin and locking device used to restrict the distance the second ball in the second ball valve may travel.

DETAILED DESCRIPTION OF THE INVENTION

Referring first to FIG. 1 and 2, the concrete pump manifold assembly 9 is shown with the inlet section 10 and outlet section 11. Concrete which has been premixed with the proper proportions of water, aggregate and cement of a predetermined size flow into inlet 10 because of the pumping action of the piston cylinder of pump 31. The manifold is mounted on the dual pump by means of a first flange 12 and a second flange 13. The specific pump 31 shown in FIG. 1 may be substantially any of the well known dual piston type concrete pumps which are commercially available, with only minor modifications in sizes and mounting means on the manifold. The preferred embodiment disclosed herein, however, has been specifically adapted for use the the Thomsen A7 concrete pump manufactured by the Thomsen Division of Royal Industries of Gardena, Calif. This type of pump characteristically has a first horizontal piston cylinder assembly, and a second piston cylinder assembly therebeside having an area approximately one half of the first piston. The first piston is driven by a conventional connecting rod assembly with the second piston being driven by such means as a cam drive system. On the delivery stroke, the first is intended to deliver one half of its output to the second piston cylinder assembly and one half to the delivery system, with the second piston cylinder assembly being intended to maintain uniform output flow on its specially shaped delivery stroke during the intake stroke of the first assembly.

The first flange 12 is mounted to the first cylinder of the pump 31 and the second flange 13 is mounted to the second cylinder of the pump 31. When the first piston disposed near the first flange 12 is withdrawn, the concrete is taken in through the inlet 12. On the power stroke of the first piston the inlet 10 is closed off by means of a ball valve and the concrete in that area is then driven through the passageway to the second piston and outlet 11. In accordance with the foregoing, when the first piston is in the power stroke, the second piston is being withdrawn with a specially shaped withdrawal stroke. Thus approximately one half of the concrete pumped by the first piston out of the first chamber 29 will be pumped out the outlet 11, the other half being taken into the second piston cylinder assembly. During the power stroke of the second piston, concrete is pumped out of the second chamber 30 into the outlet 11 while the first piston is being withdrawn thereby causing concrete to flow into the first chamber 29 from inlet 10. A second ball valve disposed about the first ball valve is forced closed by the power stroke of the second piston. It is because of the action of these two pistons and the valve configuration that continuous flow of concrete out the outlet 11 is approximated. However, the dual pistons and valves are not sufficient by themselves to overcome the problem of surging as aggregate size has a strong effect on the operations of the system. To more effectively solve the problem of surging pins in accordance with the present invention, adjustable pins are inserted into the ball valves to control the movement of the balls. Accordingly, one aspect of the present invention is the turning capability of the present invention system allowing adjustment of the ball valves without requiring disassembly.

Referring now to FIG. 2, the relative positions of the retaining pins can clearly be seen. A first and second pin, component 14 and 15 respectively, retain and control the movement of the first ball valve 23, and pin 16 controls the movement of the second ball valve 24, disposed about the first ball valve 23 in the presently preferred embodiment.

By adjusting the distance the ball in the two ball valves may travel by adjusting pins 14, 15 and 16, a continuous and steady stream of concrete is pumped out of the outlet 11. For example, in the presently preferred embodiment, on the pumping stroke of the first piston, the first ball valve 23 clearly shown in FIG. 3 closes and a second ball valve 24 opens at the same time. The second piston is now in its withdrawal stroke with the net effect that the concrete pumped through the second ball valve by the first piston flows approximately one half into the second piston's cylinder area and one half through the outlet. The purpose of these alternate piston strokes is to continue the pumping cycle of the concrete to maintain a relatively constant flow through the outlet 11. Accordingly, the second piston is controlled to minimize any surging in the system and to maintain the approximately uniform flow rate. However, without adjustment of the ball motion, variations in aggregate size vary the amount of back flow occuring before valve closure, causing irregularities in the flow. During the power stroke of the first piston the first ball valve 23 is closed so as to prevent the flow of concrete into the first chamber 29. The ball valve 23 is forced onto the first ball seat 26 or more accurately, to a closed position dependent upon the aggregate size, as the ball tends to close on the aggregate, and not the seat itself. However, the second ball valve 24 is in the open position because of the force of the concrete due to the pump piston action flowing in the upward direction. However, the second ball valve 24 is not allowed to freely travel along the passageway from the intake 10 to the area of the outlet 11 because of a retaining means. In the presently preferred embodiment the retaining means is the third adjustable pin 16 comprised of a shaped bolt with a hexagonal top 18, a tongue 19 attached to the top of the bolt 16 and a screw means 20 at the other end of the tongue. (Other adjustable retaining means, for example, a revolvable bolt with a cam disposed along its length, might also be used as an adjustment means, though the specially shaped pins are preferred as they are removable without otherwise disassembling the manifold.) The third pin 16 may be adjusted by rotating the pin and attaching the screw means 20 into any one of settings indicated as component 21. This provides a positive lock, which has been found to be desirable for this pin, and may be used also for the other pins, though it has been found that the mere tightening of the nuts on the other two pins prevents their slippage. (The head 18 of the pins not having a tongue 19 is provided with an index groove 40 to indicate the adjustment position of the pins). Also, locking is aided and leakage prevented on all pins by O rings 41 at each end of the pins, which cooperatively mate with O ring grooves in the castings.

When the piston in the first chamber region 29 is on the intake stroke thereby causing concrete to flow into the first chamber 29, the ball valve 24 is drawn downward and is disposed "on" the second ball valve seat 26 thus preventing the flow of concrete through the manifold passageway. Ball valve 24 is also forced onto ball valve seat 26 because of the positive pressure created by the second piston which is in its power stroke when the first piston is in its intake, or withdrawal stroke.

While pin 16 retards the distance that may be travelled by ball 24, pins 14 and 15 retard the distance that ball 23 may travel in the first chamber area 29. As shown in FIG. 3, the first pin 14 retards the horizontal motion of the ball. By rotating the pin 14, the horizontal motion of the ball 23 may be controlled, while the second pin 15 controls the vertical rise of the ball 23. Thus the desired flow of concrete through the first and second chambers 29 and 30 respectively, is effectively obtained by means of adjusting the travel limits of balls 23 and 24.

As previously mentioned, the ball valves will not completely rest in the valve seat 25 and 26 depending on the aggregate size, and some backflow is encountered before closure. Thus adjustment of the pins 15 and 16 allows the control of the backflow to narrow limits regardless of the aggregate size so that flow conditions for which the piston motion was tuned may be maintained when aggregate size is changed. In practice, surge has been found to be minimized by setting the pins to a predetermined position based on the aggregate size to be used, and fine tuning during operation is generally not warranted.

The side motion of ball 24 is limited by the chamber in which it is retained, and therefore is not adjustable in this embodiment. However, the flow direction around the ball is such that side motion is naturally minimal so that no adjustability has been found required or desireable. On the other hand, the flow past ball 23 has substantial horizontal components so that the time required for closure of this valve and the backflow suffered before closure, will depend on the side motion allowed this, too, depends on two factors, the first being the mechanical limit of ball travel (the pin or other stop means) and the aggregate size which tends to hold the ball off the pin. Thus, the adjustment of pin 14 is provided to better control (limit), the side motion of ball 23 without causing clogging, regardless of the aggregate size being used. Thus even under the present invention utilizing two ball valves one disposed beneath the other, some concrete may flow through the passageway 33 during the intake stroke of the first piston. However, the amount of concrete is minimal as it does not effect the unexpected efficiency and continuous flow of concrete out of outlet 11.

FIG. 3 demonstrates another unique advantage of the present invention. The manifold assembly is basically comprised of only three castings: the first forming chamber 29, the second forming chamber 30, and the third forming interconnecting passageway 33. In the presently preferred embodiment the first chamber has a generally spherical shape to maximize flow area around the ball for a minimum flow volume. The sides of the chamber 29, where the chamber joins the passageway 33, is gently tapered at approximately a 45° angle. This tapering is to prevent any possible build up of concrete in the first chamber area 29. The distance from the first chamber 29 to the second chamber 30 is a matter of choice and dependent on the specific pump utilized. The second chamber 30 is not required to be of spherical shape, but should be generally free of abrupt flow area changes outlet port 11, the preferreed embodiment is approximately 4 inches in diameter, and a standard reduction to a 3 inch diameter is welded thereto to provide both the desired reduction and a standard fitting for connection to the pipe.

When the manifold is to be assembled to the dual pistoned pump, the first flange 12, which is attached to the first chamber area 29, is bolted onto the first piston. The second flange 13 which is attached to the second chamber 30, is bolted onto the second piston of the pump. Various sizes of valve seats may be disposed on top of the first chamber 29. For example, in the present preferred embodiment valve seat 26 which is approximately 3⅞ inches in diameter is used. Other sized valve seats are a matter of choice, and dependent on the factors such as the ball diameter and aggregate size. After the valve seat is in place the passageway 33 is disposed over the valve seat so as to join the first chamber 29 with the second chamber 30. The passageway 33 is joined to the first and second chambers by means of quick release devices well known in the art.

Referring now to FIG. 4, the effect of rotating the pins 15 and 16 can be clearly seen. When bent pin 15 is rotated, the depressed area 28 of the bolt retards the upward movement of the first ball 23. When the tongue 19 on bolt 16 is rotated such that the depressed area of the bolt 16, is at its lowest ebb, the distance the second ball valve 24 may travel is also at its lower valve.

The presently preferred embodiment for controlling the distance the balls may travel in the manifold is an arrangement of a combination of pins clearly shown in FIGS. 5*a* and 5*b*. FIG. 5*a* illustrates the pin that is used for first and second pins 14 and 15 respectively.

These pins in the preferred embodiment are steel bolts which are shaped by a special fixture and hardened. Preferrably the pins are shaped so as to have an offset region 28 substantially parallel to the ends of the pins and of sufficient length so as to define the ball stop regardless of the reasonable transverse position of the ball. Similarly, the straight end portions are preferably of predetermined lengths so as to allow the threaded end to be withdrawn from the mating hole in the casting before the bend in the pin encounters the opposite side of the casting. In the presently preferred embodiment pins 14 and 15 are disposed through the first chamber 29 with their axis parallel to valve seat 25, havng at least one surface which is not concentric to the axis of rotation. The pin 16 is similarly shaped and positioned with respect to valve seat 26.

Further, the diameter in the region of the levels should not exceed the diameter of the ends, and the bends themselves should be such as to allow passage through the casting as would any conventional bolt.

The ball valves utilized in the present invention are reasonably conventional in concept, though balls of varying sizes and weights, for example hollow balls, may be used depending on the weight and size of the aggregate in the concrete being pumped. In the presently preferred embodiment, the balls are from 4 to 5 inches in diameter, hollow, and made of nickel iron. However, it is within the scope of the invention to use other types of metals and varying diameters depending on the aggregate being pumped through the manifold apparatus. When one desires to change the ball size because of the specific aggregate being pumped or because of damage done to the ball, or for cleaning, one merely has to remove the passageway section 33 of the manifold and the pins. As described the length of the pins are chosen such that when the bolt 22 is removed, the pins 14, 15 and 16 may be twisted enabling the pin to be extracted from around the ball without the requirement that the passageway 33 be detached from the manifold assembly. The inlet section 10 may be detached from the first chamber 29 by removal of first and second attaching means 34 and 35 respectively. In the presently preferred embodiment, inlet 10 is flanged to the bottom of the first chamber area 29 by means of flange 36 as shown in FIGS. 3 and 4. To make the seal as tight as possible in the present preferred embodiment, and O ring 37 is disposed between the bottom of the first chamber 29 and flange 36 and together with a shallow O ring groove in the valve seat in which the O ring rests, provides means for retaining the valve seat in the desired position. By removing the attaching means 34 and 35, the inlet pipe 10 and thus the valve seat 25 is removed, thereby providing one means of removing ball 23 from the first chamber 29. Removal of the passageway 33 provides another means to clean out the passageway and to change the ball 24 as well as ball 23 for another ball should that be desired. In addition, a clean out port 44 (see FIG. 2) is also provided to minimize the need for any disassembly.

There has been described herein a new and novel concrete pump manifold and ball valve adjustment means for use therewith which provides highly efficient relatively trouble free and low surge operation regardless of aggregate size in the concrete being pumped. However, it is to be understood that various alternate embodiments using the principles of the present invention may be incorporated by way of one specific example. Instead of the specially shaped pins of the present invention, a straight pin having a cam or other means fastened to the center thereof after assembly to the manifold might be used though such an assembly is not as convenient to use as the preferred embodiment as removal and replacement of the pins is necessarily more difficult. Thus, while one specific embodiment of the present invention has been disclosed and described in detail, herein, it will be understood by those skilled in the art that various changes in form and detail may be made therein without departing from the spirit and scope of the invention.

I claim:

1. A concrete pump manifold assembly comprising a first chamber having a concrete inlet, a concrete outlet and a means for attaching to and communicating with a pump;

a valve seat in said first chamber adjacent said inlet;

a ball in said first first chamber to inhibit flow out said concrete inlet when said ball is against said valve seat;

a first adjustment means, said ball being movable between a first position against said valve seat and a second position against said first adjustment means and displaced from said valve seat, said adjustment means being a means for changing the location of said second position with respect to said first position; and a second adjustment means, said ball also being movable to a third position against said second adjustment means, said second adjustment means being a means for adjusting the location of said third position with respect to said first position.

2. The manifold assembly of claim 1 wherein one of said first and second adjustment means limits the motion of said ball toward said pump.

3. The pump manifold of claim 1 wherein said first adjustment means is a member supported by said manifold means and rotatable about an axis generally perpendicular to the flow direction through said valve seat to provide surfaces at adjustable positions for contact by said ball to define said second position.

4. The pump manifold of claim 3 wherein said first adjustment means comprises a pin passing through said manifold means, said pin having a central portion and side sections of substantially uniform diameter, said central portion being radially offset with respect to the axis of said side sections to define a cam surface.

5. The pump manifold of claim 4 wherein said central section of said pin is of a predetermined length in relation to said side sections and said manifold means dimensions so that upon withdrawing said pin one end of said pin becomes free of one wall of said manifold means before said central section engages the opposite wall of said manifold means.

6. A concrete pump manifold assembly comprising:

a first generally spherical chamber having a concrete inlet, a concrete outlet, and a means for attaching to and communicating with a pump, the axes of said inlet, said outlet and said means for attaching to and communicating with a pump being directed toward the center of said generally spherical chamber;

a valve seat in said first chamber adjacent said inlet;

a ball in said first chamber to inhibit flow out said concrete inlet when said ball is against said valve seat;

a first adjustment means, said ball being movable between a first position against said valve seat and a second position against said first adjustment means and displaced from said valve seat, said adjustment means being a means for changing the location of said second position with respect to said first position; and a second chamber having an outlet, and an inlet coupled to said outlet of said first chamber, a valve seat between said first and second chambers, a ball in said second chamber, and an adjustment means in said second chamber to adjust the limit of travel of said last named ball away from said valve seat between said first and second chamber.

7. The manifold of claim 6 wherein said second chamber is generally spherically shaped adjacent said valve seat between said first and second chambers.

8. The manifold of claim 7 wherein said first adjustment means comprises means for adjusting said ball travel in said first chamber in the direction of said outlet and means for adjusting said ball travel in the direction of said pump.

9. The pump manifold of claim 6 wherein each said adjustment means is a member supported by said manifold means and rotatable about an axis generally perpendicular to the flow direction through said valve seat to provide surfaces at adjustable positions for contact by said ball to define said second position.

10. The pump manifold of claim 9 wherein each said adjustment means comprises a pin passing through said manifold means, said pin having a central portion and side sections of substantially uniform diameter, said central portion being radially offset with respect to the axis of said side sections to define a cam surface.

11. The pump manifold of claim 10 wherein said central section of said pin is of a predetermined length in relation to said side sections and said manifold means dimensions so that upon withdrawing said pin one end of said pin becomes free of one wall of said manifold means before said central section engages the opposite wall of said manifold means.

* * * * *